US005333419A

United States Patent [19]

Hickner

[11] Patent Number: 5,333,419

[45] Date of Patent: Aug. 2, 1994

[54] WATER DIVERTER FOR SLOPED ROOF FLASHINGS

[76] Inventor: Andrew J. Hickner, 1271 N. Hwy. 288-B, Richwood, Tex. 77531

[21] Appl. No.: 65,408

[22] Filed: May 24, 1993

[51] Int. Cl.[5] ..... E04D 13/14

[52] U.S. Cl. ..... 52/58; 52/60; 52/62; 52/13

[58] Field of Search ..... 52/58, 60, 61, 62, 94, 52/96, 412

[56] References Cited

U.S. PATENT DOCUMENTS

| | | | |
|---|---|---|---|
| 1,875,640 | 9/1932 | Moore | 52/58 |
| 1,927,881 | 9/1933 | Wetmore | 20/70 |
| 3,698,142 | 10/1972 | Theriault | 52/58 |
| 4,391,068 | 7/1983 | Kosar | 52/58 |
| 4,449,333 | 5/1984 | Stratton | 52/13 |
| 4,594,819 | 6/1986 | Kneisel | 52/60 |
| 4,781,008 | 11/1988 | Lyons, Jr. | 52/60 |
| 5,109,641 | 5/1992 | Halan | 52/62 |

OTHER PUBLICATIONS

"Lead Flashings, Weatherings, and Roofings" by Lead Development Association, 1958, pp. 24–25.

*Primary Examiner*—Carl D. Friedman
*Assistant Examiner*—Winnie Yip

[57] ABSTRACT

An improved roof flashing is disclosed for covering the abutment of a vertical wall and a sloped roof. The flashing comprises a vertical wall flange which lies in a plane which is essentially normal to the plane of the sloped roof flange. There is provided at the lower portion of the flashing, as an integral part thereof, a diverter part which spans the part of the flashing which lies along the vertical wall above the abutment and the part which lies along the sloped roof and lies at an obtuse angle to each of the said flanges. The upper surface of the diverter is an essentially triangular part with its uppermost corner integral with the flashing at the juncture of the wall part and the roof part, with the two lowermost corners joined at or near the lower edges of the wall part and the roof part in a manner which directs water falling from the flashing away from the wall.

17 Claims, 3 Drawing Sheets

100

100A

WATER DIVERTER FOR SLOPED ROOF FLASHINGS

FIELD OF THE INVENTION

A roof flashing at the juncture of a sloped roof and a vertical wall, having integral therewith a means at the low end of the flashing for diverting exiting water away from adjacent vertical wall surfaces.

BACKGROUND OF THE INVENTION

At the juncture of a sloped roof where it abuts a portion of a vertical wall there is ordinarily a flashing used to cover the juncture to prevent water from leaking down through the juncture where the vertical wall meets the sloped roof. The flashing comprises a wall flange which is mostly hidden from view beneath the wall covering and a roof flange which is mostly hidden from view by the roof covering. In the vernacular of the trade it is often referred to as a step gable/wall flashing. Such flashing often comprises a series of flashing members arranged in stepped manner each lower member being inserted an effective distance beneath the next higher member in the same manner that roofing shingles or tiles are positioned; this provides cascading of water as it flows from one overlapping portion, in turn, to the lower overlapped portion. If the wall covering and the roofing each comprises a contiguous overlay of a continuous flashing, then there may be only one lower step of flashing member positioned as the lowest part of the overall flashing arrangement. At the lowest point of the flashing arrangement, water can flow onto the wall unless there is provided a means for diverting the water away from the wall beneath the lowest portion of the flashing.

The valley at the juncture of two sloping roofs does not generally present the same problem since the lower edges of the two sloping roofs are usually offset from the walls beneath them by eaves. There is, however, a problem at the juncture of a vertical wall and a sloping roof if the wall extends beyond the eave of the sloping roof. There water being shed from the roof flows onto the portion of the wall which protrudes beyond the edge of the sloping roof where it can create stains, rotting, or other problems, depending on the type of material covering the wall at that point. Conventional means do not adequately prevent water flowing down the flashing from falling onto the vertical wall at the end of the flashing.

The problem referred to above is addressed in U.S. Pat. No. 5,109,641 which discloses a terminal flashing part for use at the low end of a juncture of a sloped roof with a vertical wall. The patent discloses, at the low end of the flashing, an offset in the part of the flashing bent at right angles (said to be "L-shaped") for the purpose of diverting rain away from the vertical wall portion which extends beyond the juncture with the sloping roof. Behind that offset in the flashing is a space provided for inserting an end of a strip of wall siding, thus that offset portion is visible when installed in position and with the siding in place. The bent portion disclosed there forms a right angle corner at the low end of the flashing, nearest the vertical wall, which can collect leaves and dirt. A collection of leaves and dirt holds moisture and the moisture causes accelerated rusting or other degradation of the flashing material, e.g., galvanized metal. Such rusting or degradation tends to shorten the useful life of the right angle diverter and can permit water to flow onto the vertical wall below the low end of the flashing.

It is an object of this invention to provide a diverter at the low end of the flashing which is slanted in a manner to direct water away from the vertical wall and which does not collect dirt or other moisture-retaining debris.

It is also an object to provide a water diverter at the low end of the flashing which permits the wall covering and the roof covering to cover substantially all of the flange portions of the flashing leaving visible only a small amount of flashing, including the diverter, providing an aesthetically attractive and beneficial covering of the juncture of the roof and wall.

It is a further object to provide a flashing with a diverter which can be made of a variety of materials, including, but not necessarily limited to, galvanized metal, corrosion resistant metal, plastic, copper, anodized aluminum, ceramic, resin-impregnated fiberglass, vitreous material, roofing tile clay, composition roofing material, impervious bonded mineral fibers, and the like.

SUMMARY OF THE INVENTION

Comprising the present invention, there is provided a flashing at the juncture of a vertical wall and a sloping roof which has a diverter part that directs water away from the vertical wall which extends beyond the eave of the sloping roof. The portion of the flashing which comprises the vertical wall flange lies in a plane which is essentially at right angle to the plane of the sloping roof flange. The diverter part comprises a triangular portion as an integral part of the flashing, with the upper corner of the triangular portion being essentially contiguous with the intersection of the vertical wall flange and the sloping roof flange. The diverter part lies in a plane which is at an obtuse angle with both the plane of the vertical wall flange and the sloping roof flange, when viewed from its top side, and the two lower corners extend to the lower edges of the vertical wall flange and the sloping roof flange.

BRIEF DESCRIPTION OF DRAWINGS

FIG. 1 depicts an embodiment to show a vertical flange and a roof flange with a triangular-shaped diverter spanning a portion of the said flanges, this embodiment representing a "left-side" flashing for use on the left end of a sloping roof where it abuts a vertical wall. The expression "left-side" as used in this specification refers to the side of the roof as viewed from the ground.

FIG. 2 depicts an embodiment, such as in FIG. 3, of a "right-side" flashing in place at the low end of the juncture of a sloping roof in abutment with a vertical wall, with roofing shingles covering the roof flange and wall siding covering the wall flange, but with the hidden outline of the covered portions of the flashing shown by dotted lines.

FIG. 3 depicts an embodiment of a "right-side" flashing, such as in FIG. 2, in place at the low end of the juncture of a sloping roof in abutment with a vertical wall, but with no roofing shown covering the roof flange and no wall covering the wall flange.

FIG. 4 depicts an embodiment, such as in FIG. 5, of a "left-side" flashing in place at the low end of the juncture of a sloping roof in abutment with a vertical wall, with roofing shingles covering the roof flange and wall siding covering the wall flange, but with the hidden outline of the flashing shown by dotted lines.

FIG. 5 depicts an embodiment of a "left-side" flashing, such as in FIG. 4, in place at the low end of the juncture of a sloping roof in abutment with a vertical wall, but with no roofing shown covering the roof flange and no wall siding covering the wall flange.

DETAILED DESCRIPTIONS INCLUDING BEST MODE CONTEMPLATED BY THE INVENTOR

In the practice of the present invention, one may select a wide variety of materials of construction which would be expected to not only provide long-term protection against rain and weather, but also provide a good aesthetic match with the materials used in the roof covering and the wall covering. One may prepare the flashing to match a tile roof, a composition roof, wood siding, brick siding, aluminum siding, vinyl siding, or ceramic siding such as transite material.

There are a number of methods and procedures by which the flashings of this invention can be formed, mostly depending on the material chosen. In the case of commonly used galvanized metal flashing material, one can even make predetermined measurements and cuttings from flat stock and then bend along predetermined lines to effect a unitary structure, which in some cases may require soldering of some edges to prevent water from leaking through where two edges meet. This can even be performed in the field by roofers. One can also cut and bend flat stock to form the wall flange and roof flange portions and then solder the diverter in place, even when the diverter has a "face" covering the area under the diverter to prevent wind blown rain from getting in up behind the diverter. Furthermore, optionally, a facia flange extending from and under the face and tucked under the facia can beneficially be provided.

There are materials which can be formed into flashings within the scope of the present inventive concept, such as by compression molding of plastic, vacuum molding of plastic, sand molding or shaping and firing of ceramic or clay materials, lay-up molding, stamping of ductile or bendable metals, injection molding of thermoset or thermoplastic materials. Choices of materials include, but are not limited to, corrosion resistant metals such as copper and anodized aluminum, galvanized metal, metal coated with paint, plastic, or resin, vinyls such as polyvinyl chloride or polyvinylidene chloride, polyolefins such as polyethylene or polypropylene filled with carbon black or other agents to protect against ultraviolet rays, polyesters, polycarbonates, polyethylene terephalate, reinforced fiberglass, and the like.

Figure 1:
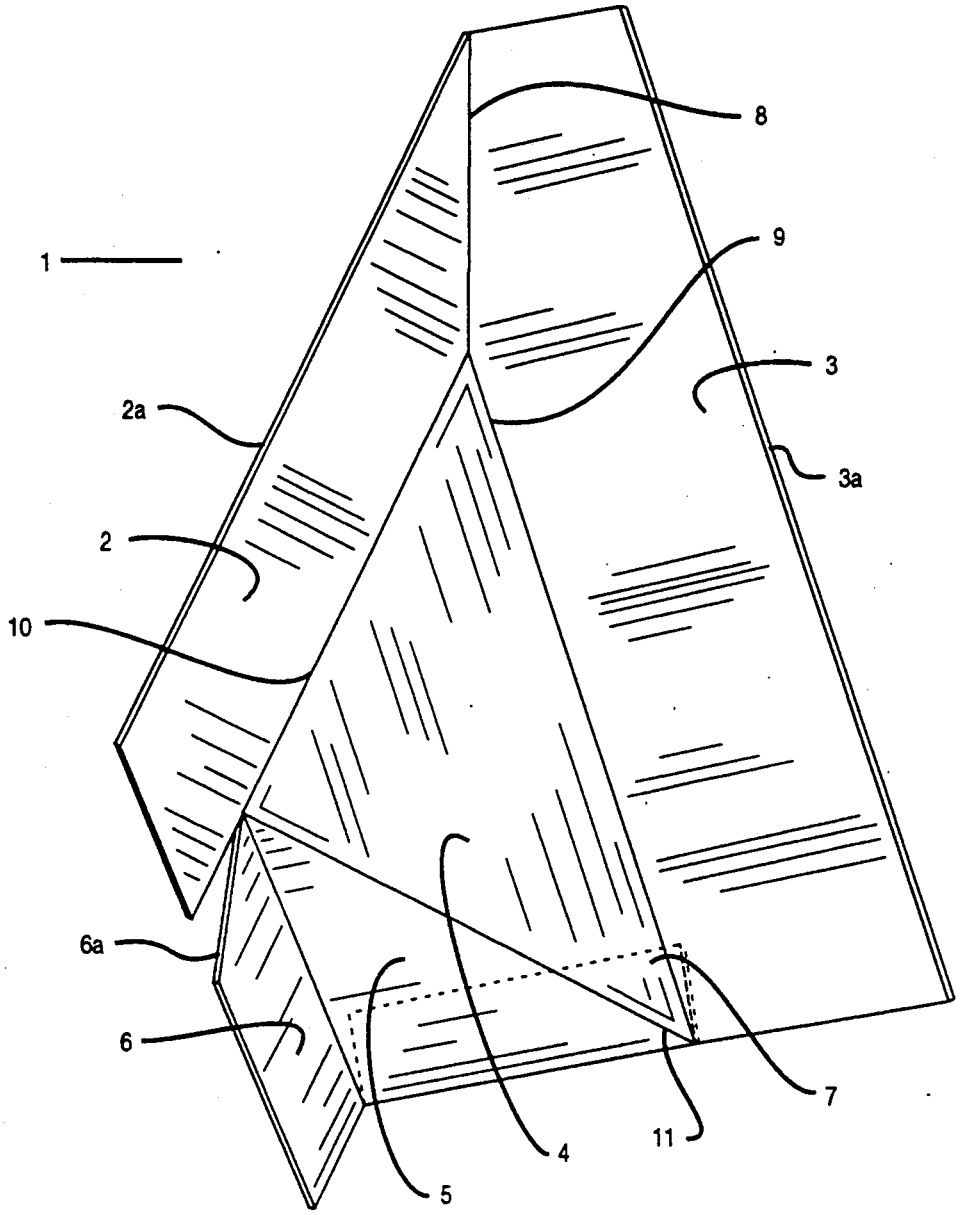
FIGS. 1–5, none of which are drawn to any particular scale, provide visual aids in relating the present invention.

FIG. 1 is a representation of an embodiment shown generally as 1 having a wall flange 2 and roof flange 3 which lie in planes essentially normal to each other, meeting at juncture 8, with diverter part 4 affixed in leak-proof manner between them at junctures 9 and 10 at an obtuse angle to each of them. Whereas those 3 parts comprise the basic concept, there is also shown affixed essentially normal to the lower edge 11 of diverter 4 a "face" 5. Whereas the face 5 is not needed for the diverter to divert falling away from a vertical wall when the flashing is positioned for use, it is beneficial in preventing rain from being wind blown into the area up behind the diverter. There is also shown another section of wall flange 6 which is beneficially provided to avert wind blown rain from getting in behind the end of a vertical wall portion at that location; when the flashing is in place, the wall flanges and roof flange are mostly covered by the wall and roof coverings. Edges **2*a*, 3*a*, and 6*a*** are shown to aid in visually perceiving the structure in three dimensions. The thickness of the edges will, of course, depend somewhat on the material of construction. Galvanized metal or copper or anodized aluminum, e.g., may be relatively thin compared with such things as flashings made with roofing tile and cast polymers, resins, reinforced fiberglass, and others.

Also shown in FIG. 1, by a dotted line, is an optional feature which can be used as further protection where a part 7 is bent backward and upward from the lower edge of diverter 4 to rest on the facia at the edge of the roof when the flashing is installed. Part 7 lies in a normal which is essentially parallel to the plane of part 5 and the plane of part 6.

The term "essentially normal" is used here to indicate that an angle is not very far from being 90 degrees, but exact dimensions needed in a particular situation often depends on fitting the flashing to the type of construction in which it is used. One of the advantages of the present flashing is that it can be made to fit a variety of locations. Some "vertical" walls may not be exactly vertical, but may intentionally have been built slanted away from true vertical. Also, the angles in the flashing are affected by the steepness of the roof. It will be appreciated that the great majority of sloping roofs, when they are longer than just a few feet, are customarily in the slope range and of which refers to the units of vertical rise to 12 units of horizontal run. Thus, for example, 5-to-12 refers to 5 units of vertical rise to 12 units of horizontal run and 12-to-12 refers to 12 units of vertical rise to 12 units of horizontal run 5-to-12 to 12-to-12. A flashing of this invention made for a 5-to-12 slope will easily work for a slope in the 4.5-to-12 to 5.5-to-12 range. A flashing made for a 12-to-12 slope will easily work for a slope in the 11.5-to-12 to 12.5-to-12 range. This same plus-or-minus units of vertical rise holds true for the ranges in between the 5-to-12 to 12-to-12 ranges.

Figure 2:
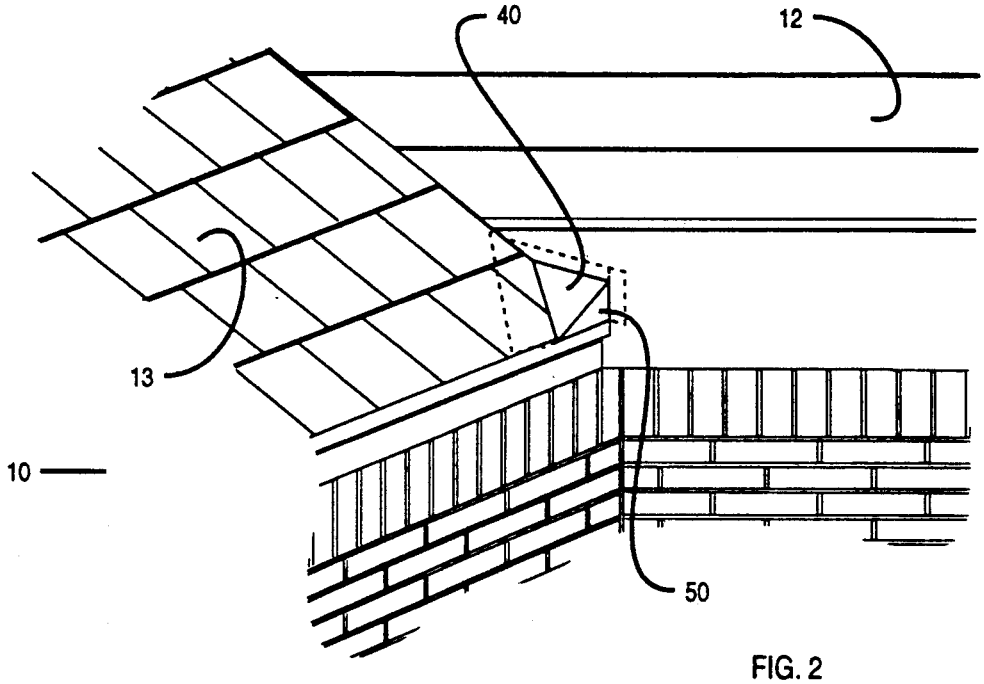
Figure 3:
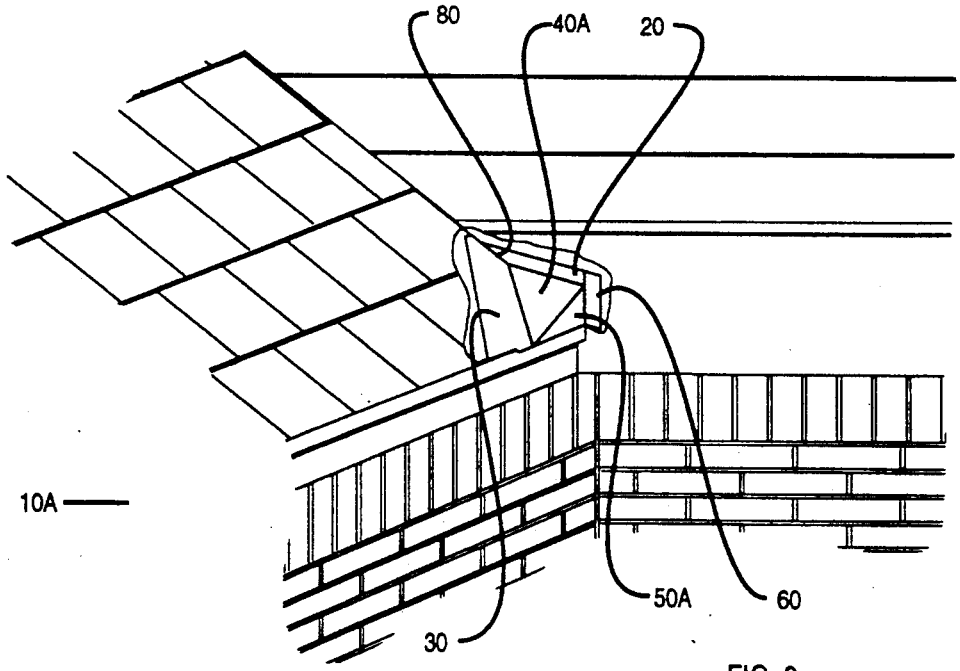

FIG. 2 denoted generally by 10 shows the installed flashing such as in FIG. 3, with the flanges covered by roof shingles 13 and siding 12, but with diverter 40 and face SO still exposed as they will be when the flashing is operably in place. The dotted indicates the location of the covered flanges under shingles 13 and siding 12.

FIG. 3 denoted generally by 10A shows an installed right-side flashing with the wall flange 20, joined at 80 with roof flange 30, diverter 40A, and face 50A and flange part 60 with none of the flanges covered by roofing or siding.

Figure 4:
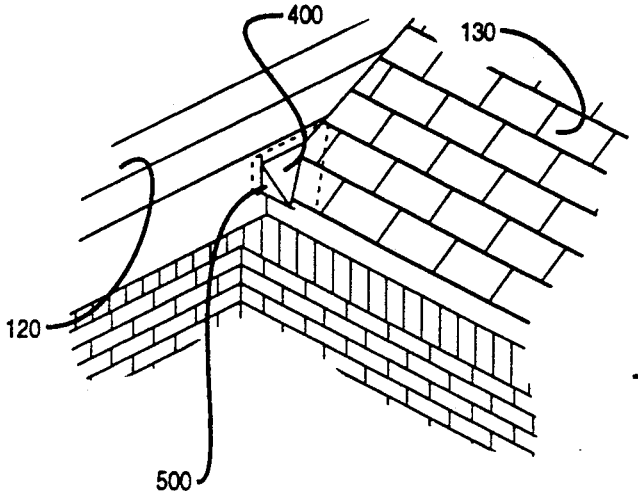

FIG. 4 denoted generally by 100 shows an installed left-side flashing with siding 120 and roofing 130, covering the wall flange and roof flange, respectively, shown as hidden by the dotted line, but with diverter 400 exposed, and face 500 exposed.

Figure 5:
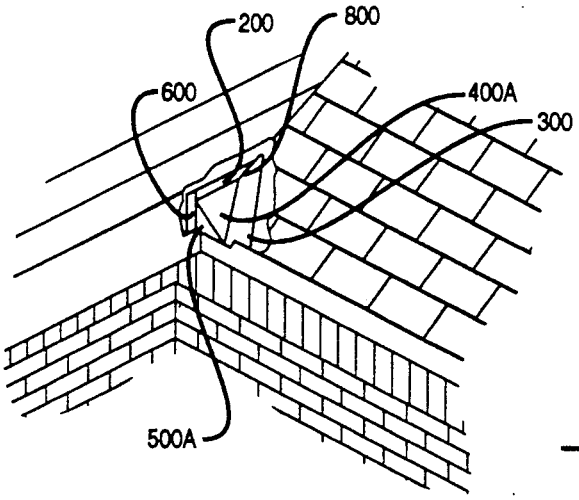

FIG. 5 denoted generally by 100A shows the an installed flashing, as in FIG. 4, with the wall flange 200 and roof flange 300 exposed, but with diverter 400 and face 500 still exposed as they will be when the flashing is operably in place. The roofing and siding are shown cut away in order to provide a view of the installed flashing with the diverter. In FIG. 5, there is shown the juncture 800 of wall flange 200 and roof flange 300 above the area spanned by diverter 400A. Also shown in FIG. 5 is the face 500A of the diverter 300 and flange part 600 such as shown in FIG. 1 as flange part 6.

EXAMPLE 1

A left-side flashing is prepared using galvanized metal substantially as depicted in FIG. 1. It comprises a roof flange about 5 inches wide as measured between a triangular diverter and the outer edge of the roof flange, and a main vertical wall flange about 3 inches wide as measured between the diverter and the outer edge of the wall flange, the wall flange being soldered to the roof flange where they come together above the uppermost point of the triangular diverter; the roof flange and wall flange are cut at angles to permit the cut edges to come together to be soldered. The area under the diverter is sealed off by a triangular "face" portion lying in a plane substantially normal to the plane in which the diverter lies and there is a second wall flange portion which protrudes at about right angle to the face portion. The face portion lies in a plane which is substantially normal to the plane of the wall flanges. The main purpose of the face at the base of the diverter is to avert wind-blown water from getting in behind the diverter. There is a small non-essential gap between the second wall flange and the main wall flange which is the result of the particular method used in forming the flashing from a contiguous piece of material by a predetermined cutting, bending and soldering operation.

Various alternatives to the specific embodiments disclosed herein may become apparent to practioners of these relevant arts upon learning of the present invention without departing from the spirit and scope of the present inventive concept. The present invention is limited only by the concept embodied in the claims.

I claim:

1. A flashing material for the juncture of a vertical wall and a sloping roof, said flashing material comprising a vertical wall flange for placement on a vertical wall, a sloping roof flange for placement on a sloping roof, and a substantially triangular diverter part, said vertical wall flange and sloping roof flange having, when considered as being in an installed position, upper portions and lower portions for placement along the juncture of a vertical wall and a sloping roof, said vertical wall flange and sloping roof flange lying in planes which are essentially normal to each other and meeting in leak-proof manner at their upper portions along a juncture which extends down to the said diverter part, said triangular diverter part spanning, in leak-proof manner, the lower portions of the vertical wall flange and the sloping roof flange, in a plane which lies at an obtuse angle to both the planes of the vertical wall flange and the sloping wall flange, with its upper corner joined in leak-proof manner with the lower end of the juncture where said wall flange and roof flange are joined, and the two lower corners of the diverter part extending to the lower portions of the wall flange and the roof flange, with one edge of the diverter joined in leak-proof manner to the wall flange and another edge of the diverter joined in leak-proof manner to the roof flange.

2. The flashing of claim 1 wherein there is, additionally, a lower portion of the diverter which extends from its lower edge, in a plane essentially normal to the diverter, and adopted toward the vertical wall blocking the path of wind-blown water up behind the diverter when the flashing is in an installed position.

3. The flashing of claim 1 wherein the flashing is constructed of corrosion resistant metal.

4. The flashing of claim 1 wherein the flashing is constructed of galvanized metal.

5. The flashing of claim 1 wherein the flashing is constructed of rust-proof metal.

6. The flashing of claim 1 wherein the flashing is constructed of copper.

7. The flashing of claim 1 wherein the flashing is constructed of molded ceramic material.

8. The flashing of claim 1 wherein the flashing is constructed of molded roofing clay.

9. The flashing of claim 1 wherein the flashing is constructed of molded resin-impregnated fiberglass.

10. The flashing of claim 1 wherein the flashing is constructed of polymer.

11. The flashing of claim 1 wherein the flashing is constructed of compression-molded polymer.

12. The flashing of claim 1 wherein the flashing is constructed as a unitary structure.

13. The flashing of claim 1 wherein the flashing is constructed in a manner so as to fit a roof slope within the range of 4.5 units of rise-to-12 units of horizontal run to 12.5 units of rise-to-12 units of horizontal run.

14. The flashing of claim 1 wherein the diverter is operably attached to a previously prepared flashing in a manner which prevents leakage onto the flanges with are positioned beneath said diverter.

15. A flashing material for the juncture of a vertical wall and a sloping roof, said flashing material comprising a vertical wall flange, a sloping roof flange, and a substantially triangular diverter part, said vertical wall flange and sloping roof flange having, when considered as being in an installed position, upper portions and lower portions for placement along the juncture of a vertical wall and a sloping roof, said vertical wall flange and sloping roof flange lying in planes which are essentially normal to each other and meeting in leak-proof manner at their upper portions along a juncture which extends down to the said diverter part, said triangular diverter part spanning, in leak-proof manner, the lower portions of the vertical wall flange and the sloping roof flange in a plane which lies at an obtuse angle to both the planes of the vertical wall flange and the sloping wall flange, with its upper corner joined in leak-proof manner with the lower end of the juncture where said wall flange and roof flange are joined, and the two lower corners of the diverter part extending to the lower portions of the wall flange and the roof flange, with one edge of the diverter joined in leak-proof manner to the wall flange and another edge of the diverter joined in leak-proof manner to the roof flange, and wherein there is, additionally, a lower portion of the diverter which extends from its lower edge, in a plane essentially vertical to the ground, and adapted toward the vertical wall, for blocking the path of wind-blown water to the juncture of the wall and roof behind the diverter when the flashing is in an installed position.

16. The flashing material of claim 15 wherein the material from which the flashing is constructed is selected from the group consisting of corrosion resistant metal, galvanized metal, copper, ceramic material, roofing clay, resin-impregnated fiberglass, plastic, and polymer.

17. The flashing material of claim 15 wherein the flashing is constructed in a manner so as to fit a roof slope which is within the range of 4.5 units of vertical rise-to-12 units of horizontal run to 12.5 units of rise-to-12 units of horizontal run.

* * * * *

UNITED STATES PATENT AND TRADEMARK OFFICE

CERTIFICATE OF CORRECTION

PATENT : 5,333,419

DATED : August 2, 1994

INVENTOR(S) : Andrew J. Hickner

It is certified that error appears in the above-identified patent and that said Letters Patent is hereby corrected as shown below:

In col. 4, line 16-17, "normal" should read --plane--.

In col. 4, line 17, "parallel" should read --normal--.

In col. 4, line 31, after "and of" insert -- 5-to-12 to 12-to-12 --.

In col. 4, line 40 after "plus-or-minus" insert -- 0.5 --.

In col. 4, line 45 "SO" should read -- 50 --.

In Claim 2, line 4, "adopted" should be --adapted--.

Signed and Sealed this

Eleventh Day of October, 1994

*Attest:*

Bruce Lehman

BRUCE LEHMAN

*Attesting Officer*

*Commissioner of Patents and Trademarks*